US011607774B2

(12) United States Patent
Mallaley et al.

(10) Patent No.: US 11,607,774 B2
(45) Date of Patent: Mar. 21, 2023

(54) BLAST MEDIA COMMINUTOR

(71) Applicant: Cold Jet, LLC, Loveland, OH (US)

(72) Inventors: Daniel Mallaley, Cincinnati, OH (US); Richard Joseph Broecker, Milford, OH (US)

(73) Assignee: Cold Jet, LLC, Loveland, OH (US)

( * ) Notice: Subject to any disclaimer, the term of this patent is extended or adjusted under 35 U.S.C. 154(b) by 787 days.

(21) Appl. No.: 15/297,967

(22) Filed: Oct. 19, 2016

(65) Prior Publication Data

US 2017/0106500 A1 Apr. 20, 2017

Related U.S. Application Data

(60) Provisional application No. 62/243,647, filed on Oct. 19, 2015.

(51) Int. Cl.

| | |
|---|---|
| ***B02C 4/02*** | (2006.01) |
| ***B24C 7/00*** | (2006.01) |
| ***B02C 4/32*** | (2006.01) |
| ***B24C 1/00*** | (2006.01) |

(52) U.S. Cl.

CPC ..... *B24C 7/0046* (2013.01); *B02C 4/02* (2013.01); *B02C 4/32* (2013.01); *B24C 1/003* (2013.01)

(58) Field of Classification Search

CPC .. B02C 4/02; B02C 4/08; B02C 4/283; B02C 4/30; B02C 4/32; B02C 19/0056; B24C 1/003; B24C 7/0046; Y10S 241/17

USPC .... 241/17, 18, 57, 185.5, 185.6, 187, 188.1, 241/220, 221, 222, 227, 235, 236, 245, 241/251, 253, 257.1, 259, 259.3, 23, 5, 241/48, 61, 97

See application file for complete search history.

(56) References Cited

U.S. PATENT DOCUMENTS

| | | | | |
|---|---|---|---|---|
| 3,866,842 | A | 2/1975 | Linzberger | |
| 4,709,864 | A * | 12/1987 | Henne | B02C 4/286 241/230 |
| 4,744,181 | A | 5/1988 | Moore et al. | |
| 4,843,770 | A | 7/1989 | Crane et al. | |
| 5,018,667 | A | 5/1991 | Lloyd | |
| 5,050,805 | A | 9/1991 | Lloyd et al. | |
| 5,071,289 | A | 12/1991 | Spivak | |

(Continued)

FOREIGN PATENT DOCUMENTS

| | | |
|---|---|---|
| CN | 101932409 | 12/2010 |
| DE | 102011008139 A1 | 7/2012 |

(Continued)

OTHER PUBLICATIONS

International Search Report and Written Opinion dated Feb. 6, 2017 for Application No. PCT/US2016/057718, 10 pgs.

*Primary Examiner* — Faye Francis

(74) *Attorney, Agent, or Firm* — Frost Brown Todd LLP

(57) ABSTRACT

A comminutor reduces the size of particles of frangible blast media from each particle's respective initial size to a size smaller than a desired maximum size. The frangible blast media may be entrained in a flow of transport gas. The comminutor includes an inlet and an outlet, both in fluid communication with an internal flow passageway. The internal flow passageway includes a first intermediate passageway which comprise the gap defined by two rotating rollers and a second intermediate passageway which includes an inlet disposed proximal the gap, extending in an upstream direction therefrom.

12 Claims, 9 Drawing Sheets

(56) References Cited

U.S. PATENT DOCUMENTS 5,096,131 A * 3/1992 Patzelt ..... B02C 4/286 241/224
5,188,151 A 2/1993 Young et al.
5,249,426 A 10/1993 Spivak et al.
5,288,028 A 2/1994 Spivak et al.
5,301,509 A 4/1994 Lloyd et al.
5,473,903 A 12/1995 Lloyd et al.
5,520,572 A 5/1996 Opel et al.
6,024,304 A 2/2000 Sawada
6,042,458 A 3/2000 Lehnig et al.
6,199,778 B1 * 3/2001 Hanvey, Jr. ..... B02C 4/08 241/152.2
6,346,035 B1 2/2002 Anderson et al.
6,524,172 B1 2/2003 Rivir et al.
6,695,679 B2 2/2004 Anderson et al.
6,695,685 B2 2/2004 Stratford et al.
6,726,549 B2 4/2004 Rivir et al.
6,739,529 B2 5/2004 Linger et al.
6,824,450 B2 11/2004 Opel
7,112,120 B2 9/2006 Rivir et al.
7,950,984 B2 5/2011 Rivir et al.
7,997,516 B2 * 8/2011 Raaz ..... B02C 4/02 241/235
8,187,057 B2 5/2012 Broecker
8,277,288 B2 10/2012 Spivak et al.
8,869,551 B2 10/2014 Young et al.
9,095,956 B2 8/2015 Broecker et al.
9,409,179 B2 * 8/2016 Ueda ..... B02C 4/44
9,592,586 B2 3/2017 Lehnig et al.
9,931,639 B2 4/2018 Lehnig
10,315,862 B2 * 6/2019 Mallaley ..... B24C 1/003
2002/0074438 A1 6/2002 Horigane et al.
2003/0199232 A1 10/2003 Rivir et al.
2009/0093196 A1 4/2009 Dressman
2010/0301145 A1 * 12/2010 Memari Fard ..... B02C 4/02 241/17
2011/0104993 A1 5/2011 Nishimura
2012/0291479 A1 11/2012 Moore et al.
2014/0110510 A1 4/2014 Rivir et al.
2015/0165394 A1 * 6/2015 Leininger ..... F23G 5/008 241/98
2015/0166350 A1 6/2015 Fritz et al.
2015/0196921 A1 7/2015 Lehnig
2015/0375365 A1 12/2015 Lehnig et al.
2016/0257506 A1 9/2016 Mallaley et al.
2017/0106500 A1 4/2017 Mallaley et al.
2021/0252520 A1 * 8/2021 Schneider ..... B02C 9/04

FOREIGN PATENT DOCUMENTS

EP 2343157 A1 * 7/2011 ..... B24C 1/003
EP 2994268 3/2016
JP S49-104381 9/1974
JP S59-104218 7/1984
JP S61-19442 U 2/1986
WO WO 94/16861 A1 8/1994
WO WO 1994/023896 A1 10/1994
WO WO 2014/182254 A1 11/2014
WO WO 2015/109354 A2 7/2015

* cited by examiner

BLAST MEDIA COMMINUTOR

TECHNICAL FIELD

The present invention relates to method and apparatus for reducing the size of frangible particles, and is particularly directed to a method and apparatus for reducing the size of cryogenic blast media. The invention will be disclosed in conjunction with a method and apparatus for reducing the size of carbon dioxide particles entrained in a flow.

BACKGROUND

Carbon dioxide systems, including apparatuses for creating solid carbon dioxide particles, for entraining particles in a transport gas and for directing entrained particles toward objects are well known, as are the various component parts associated therewith, such as nozzles, are shown in U.S. Pat. Nos. 4,744,181, 4,843,770, 5,018,667, 5,050,805, 5,071,289, 5,188,151, 5,249,426, 5,288,028, 5,301,509, 5,473,903, 5,520,572, 6,024,304, 6,042,458, 6,346,035, 6,524,172, 6,695,679, 6,695,685, 6,726,549, 6,739,529, 6,824,450, 7,112,120, 7,950,984, 8,187,057, 8,277,288, 8,869,551 and 9,095,956, all of which are incorporated herein in their entirety by reference. Additionally, U.S. patent application Ser. No. 11/853,194, filed Sep. 11, 2007, for Particle Blast System With Synchronized Feeder and Particle Generator; U.S. Patent Provisional Application Ser. No. 61/589,551 filed Jan. 23, 2012, for Method And Apparatus For Sizing Carbon Dioxide Particles; U.S. Patent Provisional Application Ser. No. 61/592,313 filed Jan. 30, 2012, for Method And Apparatus For Dispensing Carbon Dioxide Particles; U.S. patent provisional application Ser. No. 13/475,454, filed May 18, 2012, for Method And Apparatus For Forming Carbon Dioxide Pellets; U.S. patent application Ser. No. 13/757,133, filed Feb. 1, 2013, for Apparatus And Method For High Flow Particle Blasting Without Particle Storage; U.S. patent application Ser. No. 14/062,118 filed Oct. 24, 2013 for Apparatus Including At Least An Impeller Or Diverter And For Dispensing Carbon Dioxide Particles And Method Of Use; U.S. patent application Ser. No. 14/516,125, filed Oct. 16, 2014, for Method And Apparatus For Forming Solid Carbon Dioxide; U. S. patent application Ser. No. 14/596607, filed Jan. 14, 2015 for Blast Media Fragmenter; U.S. Patent Provisional Application Ser. No. 62/129,483 filed Mar. 6, 2015, for Particle Feeder; and U.S. patent application Ser. No. 14/849,819, filed Sep. 10, 2015, for Apparatus And Method For High Flow Particle Blasting Without Particle Storage, all of which are incorporated herein in their entirety by reference.

For some applications, it may be desirable to have small particles, such as in the size range of 3 mm diameter to 0.3 mm diameter. U.S. Pat. No. 5,520,572 illustrates a particle blast apparatus that includes a particle generator that produces small particles by shaving them from a carbon dioxide block and entrains the carbon dioxide granules in a transport gas flow without storage of the granules. U.S. Pat. No. 6,824,450 and US Patent Publication No. 2009-0093196A1 disclose a particle blast apparatus that includes a particle generator that produces small particles by shaving them from a carbon dioxide block, a particle feeder which receives the particles from the particle generator and entrains them which are then delivered to a particle feeder which causes the particles to be entrained in a moving flow of transport gas. The entrained flow of particles flows through a delivery hose to a blast nozzle for an ultimate use, such as being directed against a workpiece or other target.

Although systems such as that illustrated in U.S. Pat. No. 5,520,572 and US Patent Publication No. 2009-0093196A1 perform well, they are not configured for continuous use as a result of the source of particles being a carbon dioxide block. When the carbon dioxide block runs out, particle blasting has to stop while a new carbon dioxide block is loaded into the apparatus.

In addition to not being a continuous process, carbon dioxide blocks are not always readily available. In contrast, particles of carbon dioxide may be made on site by pelletizers, such as shown in US Patent Publication No. 2014-0110501A1. The particles, which may also be referred to as pellets, formed by such pelletizers are substantially larger than the size of particles in the size range desired for the ultimate use. Pelletizers may be stand alone, or may be incorporated as a component of a particle blast apparatus such as shown in U.S. Pat. No. 4,744,181, feeding directly into a hopper that delivers particles to the charging station of a particle feeder. Additionally, particles may be formed elsewhere and delivered to the location of the particle blast apparatus. Small particles, in contrast, are typically too small to last long enough to be transported from where they are made to where the particle blast apparatus is located.

BRIEF DESCRIPTION OF THE DRAWINGS

The accompanying drawings illustrate embodiments which serve to explain the principles of the present innovation.

DETAILED DESCRIPTION

Figure 1:
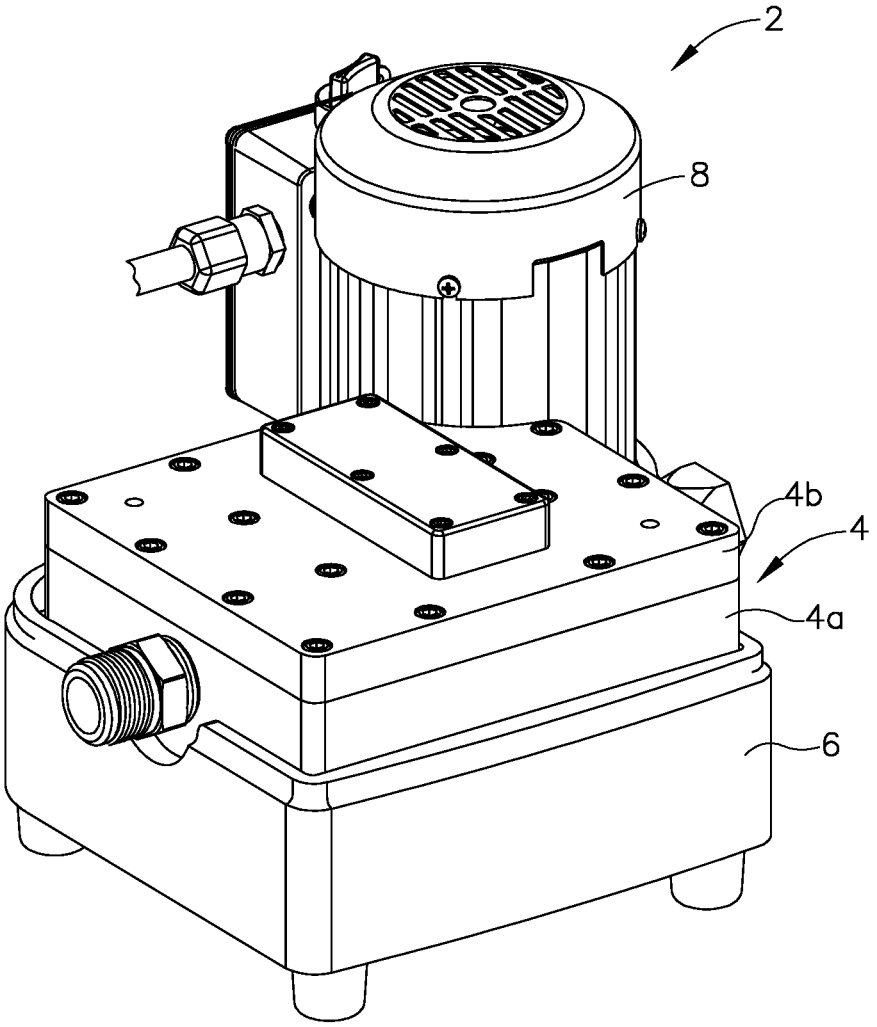
FIG. 1 illustrates a comminutor.

In the following description, like reference characters designate like or corresponding parts throughout the several views. Also, in the following description, it is to be understood that terms such as front, back, inside, outside, and the like are words of convenience and are not to be construed as limiting terms. Terminology used in this patent is not meant to be limiting insofar as devices described herein, or portions thereof, may be attached or utilized in other orientations. Referring in more detail to the drawings, one or more embodiments constructed according to the teachings of the present innovation are described.

Although this patent refers specifically to carbon dioxide in explaining the invention, the invention is not limited to carbon dioxide but rather may be utilized with any suitable frangible material as well as any suitable cryogenic material. References herein to carbon dioxide, at least when describing embodiments which serve to explain the principles of the present innovation are necessarily limited to carbon dioxide but are to be read to include any suitable frangible or cryogenic material.

Figure 2:
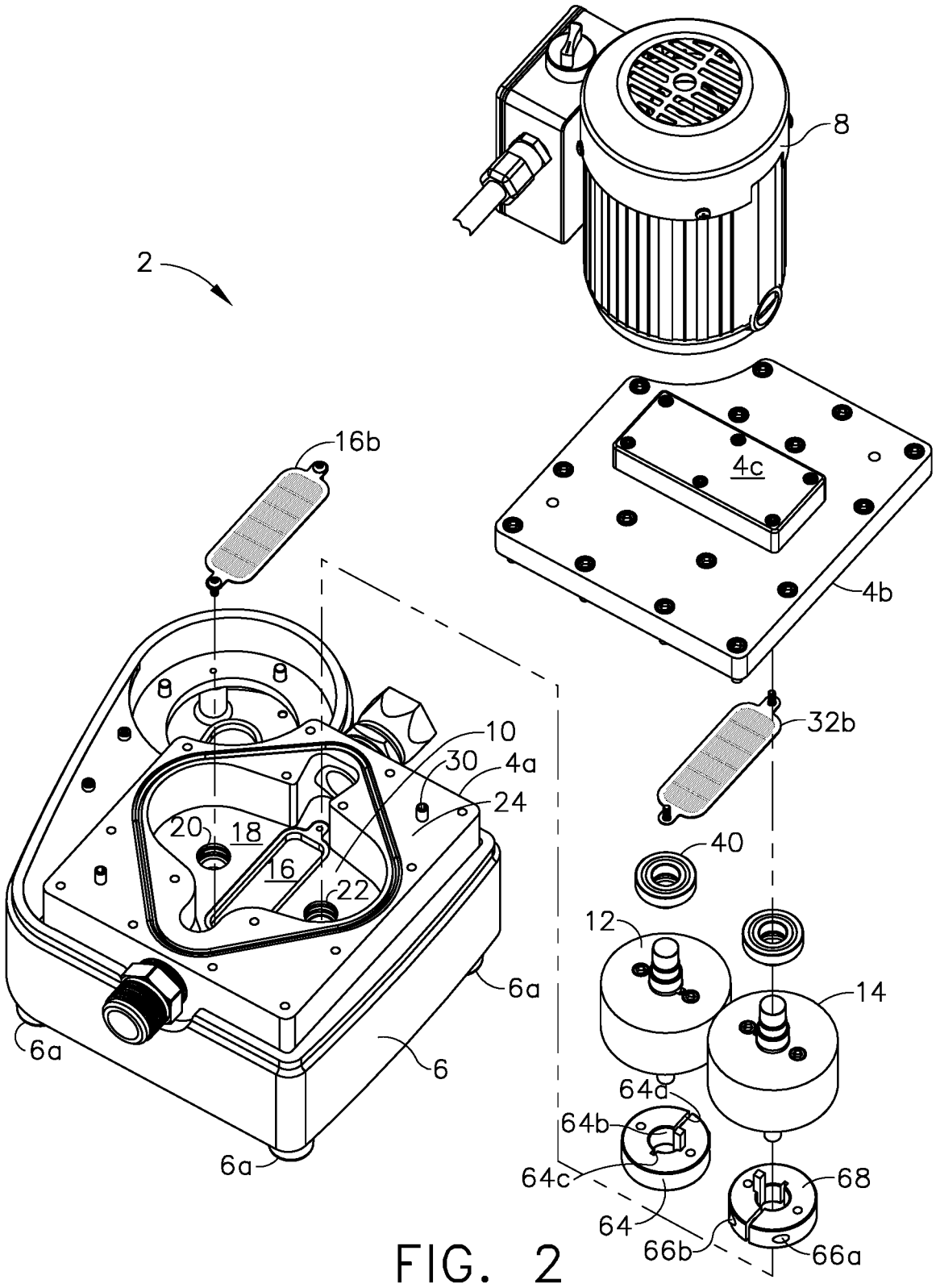
FIG. 2 is an exploded view of the comminutor of FIG. 1.

Referring to FIGS. 1 and 2, there is shown comminutor, generally indicated at 2, configured for use as a component of a carbon dioxide particle blast system. Comminutor 2 includes body 4 and, in the embodiment depicted, housing 6, and motor 8. Body 4 includes lower body 4*a* and upper body 4*b*, which may be made of any suitable material, such as without limitation aluminum, stainless steel, plastic or composites. In the embodiment depicted, comminutor 2 is configured to be disposed separate. In the embodiment illustrated, housing 6 carries body 4 and includes a plurality of feet 6*a* which allows comminutor 2 to be placed on a floor when it is disposed inline between an upstream delivery hose (not shown) bringing the flow of entrained particles and a downstream delivery hose (not shown) carrying the entrained comminuted particles to the blast nozzle. Housing 6 also encloses the transmission that connects rollers 12, 14 to motor 8. Comminutor 2 may alternately be located within the housing of a cart which carries the particle feeder (not shown), connected directly to the outlet of the particle feeder (not shown), in which case housing 6 may optionally be omitted.

Figure 3:
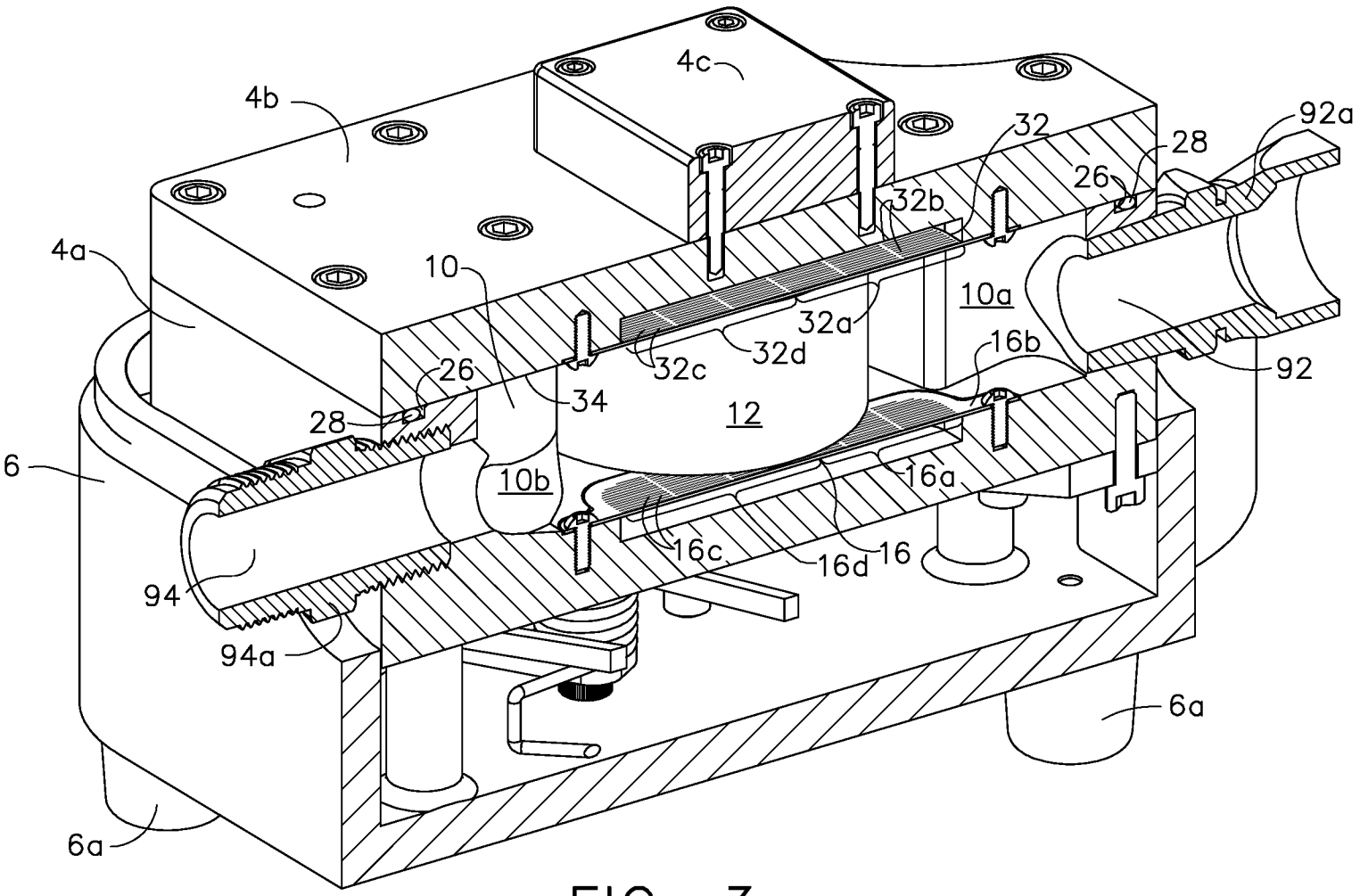
FIG. 3 is perspective cross-sectional view of the comminutor of FIG. 1 taken through a vertical plane passing through the midline of the inlet.

Lower body 4*a* defines internal cavity 10, within which rotatable rollers 12, 14 are disposed. Lower body 4*a* defines recess 16 located in surface 18, and includes two spaced apart roller shaft openings 20, 22. As seen in FIGS. 2 and 3, upper surface 24 of lower body 4*a* includes seal groove 26, in which seal 28 is disposed so as to seal against upper body 4*b* when upper body 4*b* is secured to lower body 4*a*. Locating pins 30 extend from upper surface 24 of lower body 4*a* to locate upper body 4*b* relative to lower body 4*a*. Referring also to FIG. 3, upper body 4*b* defines recess 32 located in surface 34. Cover 4*c* is disposed atop upper body 4*b* and entraps bearings 40.

Figure 4A:
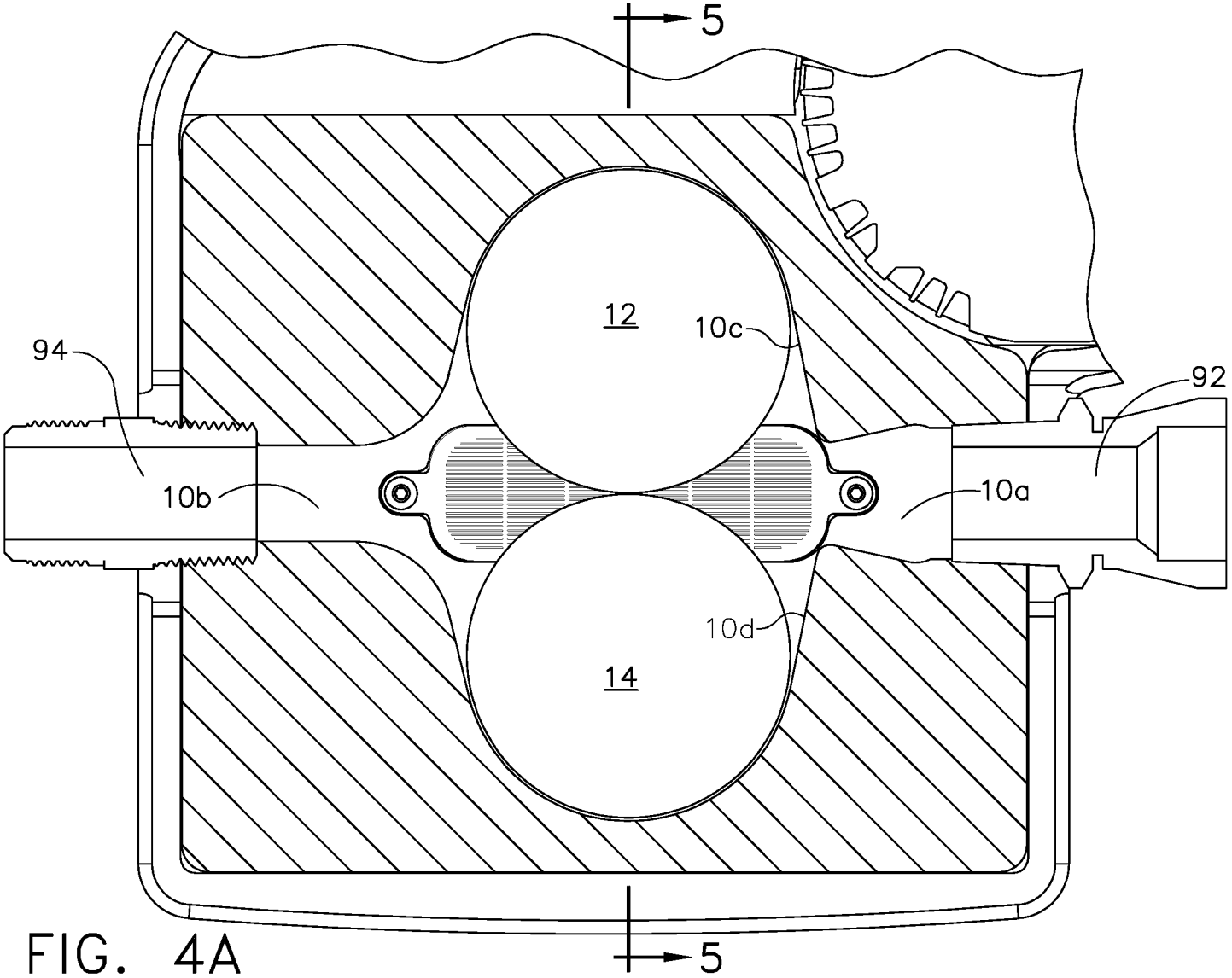
FIG. 4A is a top cross-sectional view of the comminutor of FIG. 1 taken through a horizontal plane passing through the midline of the inlet.
Figure 4B:
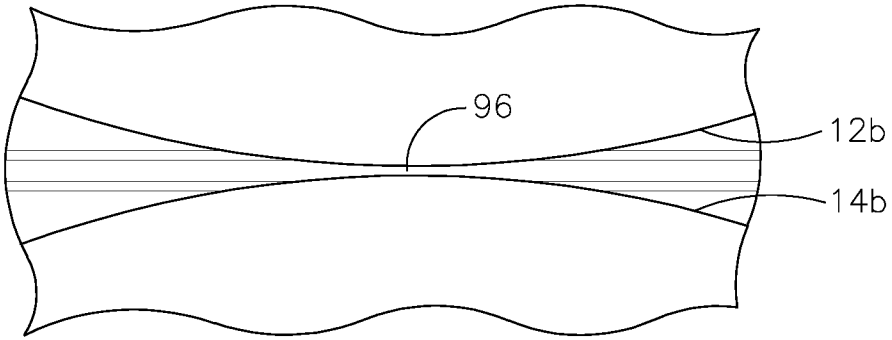
FIG. 4B is an enlarged, fragmentary top view taken from FIG. 4A illustrating gap 96 between peripheral surfaces 12*b* and 14*b*.
Figure 4C:
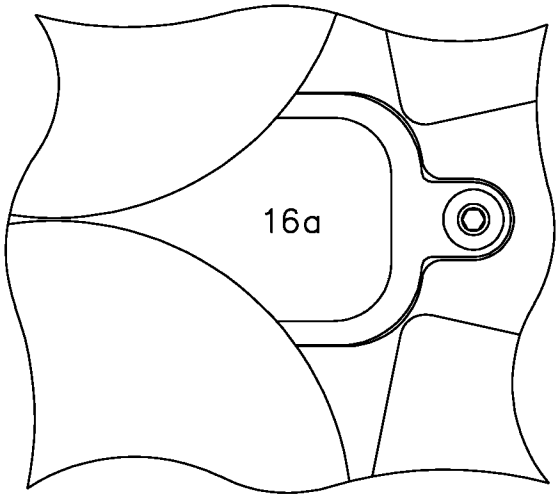
FIG. 4C is an enlarged, fragmentary top view taken from FIG. 4A illustrating inlet 16*a*.
Figure 5:
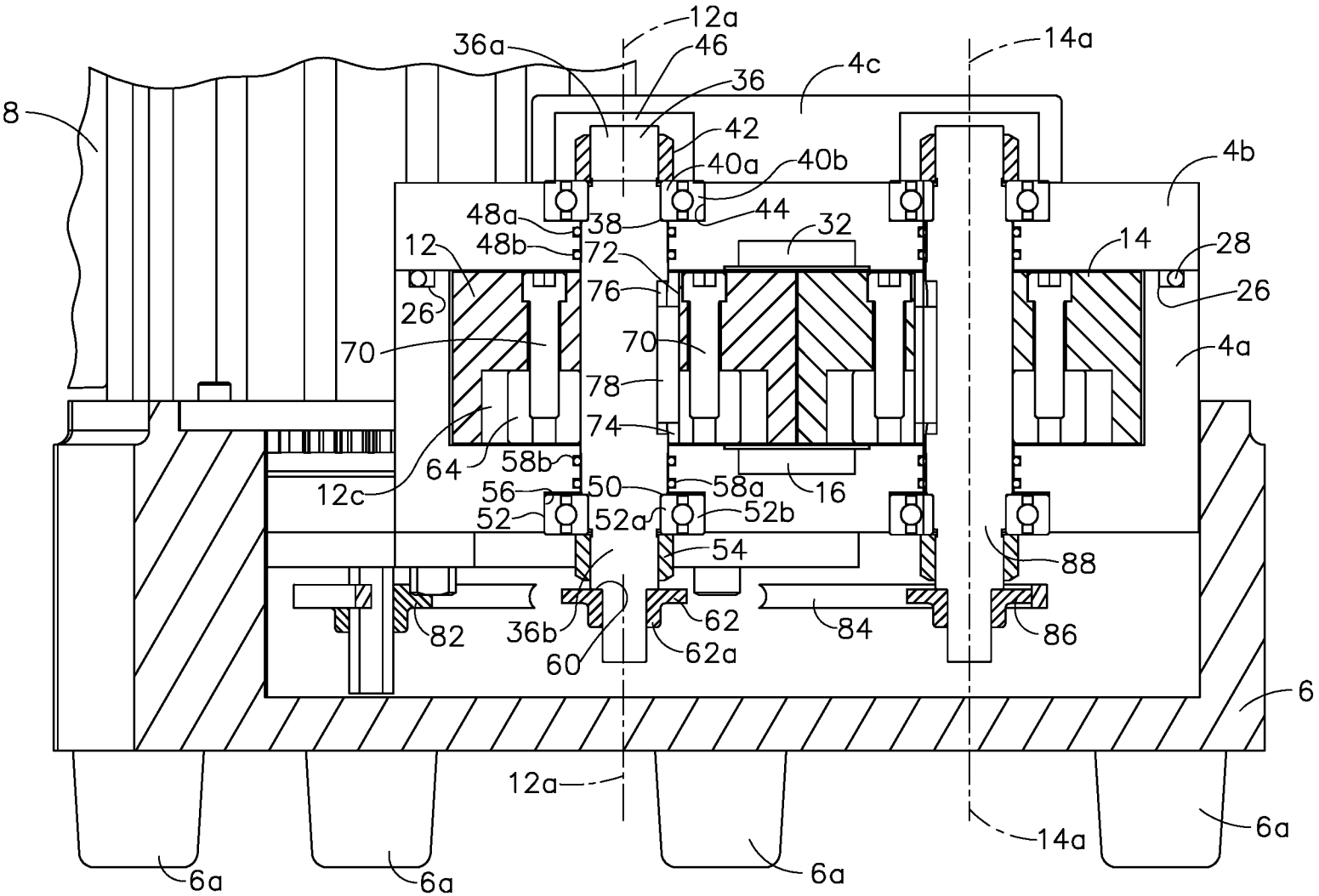
FIG. 5 is a side cross-sectional view taken along line 5-5 of FIG. 4A.

Referring also to FIGS. 4A and 5, rollers 12, 14 are rotatable about respective, spaced apart, generally parallel axes of rotation 12*a*, 14*a*. Each roller 12, 14 is supported in a similar manner, so only the support of roller 12 will be described. Shaft 36 is disposed to be rotatable about axis 12*a*. Upper end 36*a* of shaft 36 includes bearing shoulder 38 which inner race 40*a* of upper bearing 40 contacts. Inner race 40*a* may be held against shoulder 38 by nut 42 which threadingly engages upper end 36*a*, but any suitable configuration may be used to hold inner race 40*a* against shoulder 38. Upper body 4*b* includes bearing bore 44 sized for outer race 40*b*. Cover 4*c* includes cavity 46 which provides clearance for upper end 36*a* and nut 42. Cavity 46 is sized to retain outer race 40*b* in bearing bore 44. Upper body 4*b* may include a one or more seals 48*a*, 48*b*, disposed in respective grooves.

The configuration of lower end 36*b* of shaft 36 is similar to upper end 36*a*. Lower end 36*b* of shaft 36 includes bearing shoulder 50 which inner race 52*a* of lower bearing 52 contacts. Inner race 52*a* may be held against shoulder 50 nut 54 which threadingly engages lower end 36*b*, but any suitable configuration may be used to hold inner race 52*a* against shoulder 50. Lower body 4*a* includes bearing bore 56 sized for outer race 52*b*. Lower body 4*a* may include a one or more seals 58*a*, 58*b*, disposed in respective grooves.

Lower end 36*b* extends beyond nut 54, and includes shoulder 60. Sprocket 62 is nonrotatably secured to shaft 36, such as via a set screw (not illustrated) through sprocket hub 62*a*.

Collar 64 is disposed about shaft 36 adjacent surface 18. Collar 64 has slot 64*a* through at least one side of collar 64 into bore 64*b*. There may also be slot 64*c* formed opposite slot 64*a*. Slots 64*a* and 64*c* allows collar 64 to flex when threaded fasteners are disposed in a horizontal bore threaded at one end, spanning slot 64*a* (not visible for collar 64, but corresponding to horizontal bore 66*a* and threaded boor 66*b* of collar 68 identified in FIG. 2), used to draw the opposite sides of slot 64*a* toward each other to secure collar 64 to shaft 36.

Roller 12 is secured to collar 64 by one or more fasteners 70, with collar 64 disposed in recess 12*c* of roller 12, permitting roller 12 to be disposed abutting collar 64. Thus, the clearance for roller 12 between surface 18 and surface 34 is established by the tolerance stack up of roller 12 and collar 64 relative to the tolerance of the height of walls 10*c*, 10*d* and the flatness of surfaces 18 and 34.

Roller 12 includes keyway 72, collar 64 includes keyway 74, and shaft 36 includes keyway 76. Key 78 is disposed in keyways 72, 74 and 76, keying shaft 36 to collar 64 and roller 12, such that rotation of shaft 36 causes rotation of roller 12.

Figure 7:
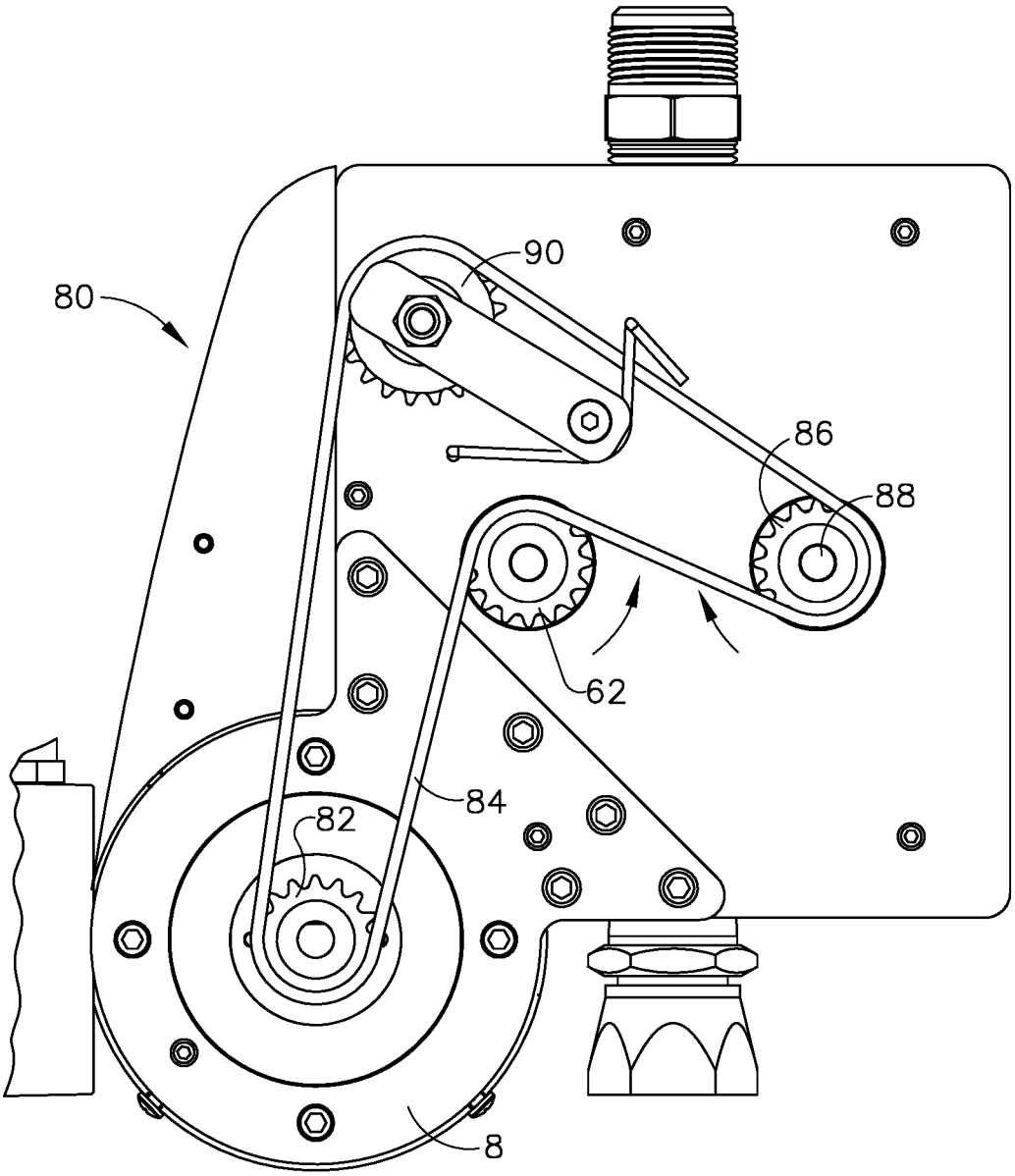
FIG. 7 is bottom cross-sectional view taken along line 7-7 of FIG. 6.

Referring to FIG. 7, drive train 80 is illustrated. Motor 8 includes drive sprocket 82 which engages and drives chain 84. Chain 84 engages and drives sprocket 62 of shaft 36/roller 12 and sprocket 86 of shaft 88/roller 14, with idler sprocket 90 resiliently biased to maintain appropriate tension in chain 84. Chain 84 is routed so that rollers 12 and 14 rotate in opposite directions so as to create a nip line therebetween, as described below. Rollers 12 and 14 may rotate at the same speed, which would result from sprockets 62 and 88 being the same size with consistent tension therebetween. Alternately, in accordance with the discussion below, drive train 80 could be configured to produce a difference between the rotational speeds of rollers 12 and 14. Drive train 80 may be of any suitable configuration, including without limitation, a gear drive train. Additionally, drive train 80, alone or in conjunction with the configuration of rollers 12, 14 and orientation thereof to shafts 36, 88, may be configured to provide controlled alignment between the surfaces of rollers 12 and 14.

Body 4 includes inlet 92 and outlet 94. In in the embodiment depicted, fitting 92*a* defines the flow area of inlet 92 and fitting 94*a* defines the flow area of outlet 94. In this embodiment, fitting 92*a* is configured to be connected to a source of entrained particle flow, such as an upstream delivery hose (not shown) which may be in fluid communication upstream with the discharge of the particle feeder. Fitting 94*a* is configured to be connected to a downstream delivery hose (not shown) for carrying the entrained particles, which have been comminuted by rollers 12, 14, downstream to the blast nozzle.

Referring to FIGS. 4A, 4*b*, 4C and 6, axes of rotation 12*a* and 14*a* are spaced far enough such that peripheral surfaces 12*b*, 14*b* of rollers 12, 14 define gap 96 therebetween, extending the axial length of rollers 12, 14. The clearance between the ends of rollers 12, 14, and surfaces 18, 34 of lower body 4*a* and upper body 4*b* is, in the depicted embodiment, 0.381 mm. Gap 96 may be of any width suitable to fracture particles entering comminutor 2 through inlet 92, as discussed below.

With reference to FIGS. 3, 4A, 4B, 4C and 6, a flow passageway is defined within body 4 by portion 10*a* of internal cavity 10, gap 96, recesses 16, 32 and portion 10*b* of internal cavity 10, which places inlet 92 in fluid communication with outlet 94. Transport gas enters through inlet 92 with particles entrained. The transport gas flows through portion 10*a*, directed toward gap 96. Although some transport gas may flow between peripheral surfaces 12*b*, 14*b* and internal cavity walls 10*c*, 10*d*, as well as between the upper and lower ends of rollers 12, 14 and surfaces 18, 34, any such flow is small compared to the total flow of the transport gas, such that the internal flow passageway is substantively portion 10*a* defined by body 4, gap 96 and recesses 16, 32 and portion 10*b*. The internal flow passageway between portion 10*a* and portion 10*b* comprises a first intermediate passageway defined by gap 96 and a second intermediate passageway defined by recesses 16 and 32. In the embodiment depicted, the second intermediate passageway comprises recesses 16 and 32, and the second intermediate passageway inlet, which comprises in the embodiment depicted inlets 16*a* and 32*a* of recesses 16 and 32, is disposed proximal gap 96 in surface 18 and in surface 34, extending upstream therefrom toward inlet 92.

This configuration results in the transport gas to continue flowing forward toward gap 96, generally in the same direction as the transport gas flows into inlet 92. Although gap 96, the first intermediate passageway of the flow passageway, presents an impediment to the flow of transport gas therethrough, the second intermediate passageway of recesses 16 and 32 present very little resistance to flow of the transport gas, and the transport gas can flow relatively unimpeded through inlets 16*a*, 32*a* as well as right up to gap 96, since inlets 16*a*, 32*a* is proximal gap 96 and extends upstream therefrom. The flow area provided by the second intermediate passageway viz a viz inlets 16*a*, 32*a* and recesses 16, 32 may be approximately the same as, or no smaller than, the flow area of inlet 92. The second intermediate passageway and inlet to the second intermediate passageway is sized, configured and disposed, in total, so as to result in minimal to no back pressuring of the transport gas flow so that there is not reduction in speed of the transport gas. Screens 16*b*, 32*b* are disposed over recesses 16*b*, 32*b* at inlets 16*a*, 32*a*, defining a plurality of slots 16*c*, 32*c*, which have respective widths smaller than the smallest particle size that is to be created by rollers 12, 14 comminuting the incoming particles though gap 96. The total open area of slots 16*c*, 32*c* at inlets 16*a*, 32*a* is configured so that there is not a reduction in speed of the transport gas, and the total open area of slots 16*c*, 32*c* at inlets 16*a*, 32*a* may be approximately the same as, or no smaller than, the flow area of inlet 92.

As can be seen in FIGS. 3 and 4A, recesses 16, 32 also extend downstream of gap 96, which functions as outlets 16*d*, 32*d* of the second intermediate passageway defined by recesses 16, 32. The flow area of outlets 16*d*, 32*d* is approximately at least as large as the flow area of inlets 16*a*, 32*a*, so that flow through the second intermediate passageway is not restricted as it exits and rejoins the portion of the flow and the comminuted particles exiting gap 96. The total open area of slots 16*c*, 32*c* at outlets 16*d*, 32*d* is similarly configured so that there is not a reduction in the speed of the transport gas flowing through the second intermediate passageway. The faster flow exiting outlets 16*d*, 32*d* has a lower pressure (per the Bernoulli's principle) than the slower moving fluid flowing through gap 96. The lower pressure rejoining flow from the second intermediate passageway pulls the slower moving fluid through the first intermediate passageway. Alternatively, the portion of screens 16, 32 at outlets 16*d*, 32*d* may be omitted since only at inlets 16*a*, 32*a* is there a need to block particles larger than the desired maximum size from entering the second intermediate passageway.

The proximity of inlets 16*a*, 32*a* to gap 96 allows the transport gas to retain its flow direction and speed approaching gap 96, the entrained particles are delivered to gap 96. As the transport gas flow curves to flow out inlets 16*a*, 32*a*, the forward velocity of the entrained particles results in the particles continuing generally straight forward to engage peripheral surfaces 12*b*, 14*b* of rollers 12, 14 such that the particles are advanced by rollers 12, 14 through gap 96, comminuting each particle from its respective initial size to a size smaller than a desired maximum size.

In the embodiment depicted, the distance between axes of rotation 12*a*, 14*a* is fixed, thereby establishing a fixed width for gap 96. Alternately, comminutor 2 may be configured such that one or both of axes 12*a*, 14*a* may be moved away from or toward each other, such as such that both axes 12*a*, 14*a* are always in the same plane regardless of the distance therebetween. In the case of such configuration of comminutor 2, it is desirable not to open up any additional flow passageways for the transport gas with the variable setting of the width of gap 96: The internal flow passageway as described above continues to carry substantially all of the transport gas and particles. If both axes 12*a*, 14*a* are configured to be moveable, comminutor 2 may be configured such that the center of gap 96 remains aligned with the center of inlet 92. If only one of axes 12*a*, 14*a* is configured to be moveable, comminutor 2 may be configured such that the roller of the non-moveable axes is located such that its peripheral surface at gap 96 is aligned with the horizontal edge of inlet 92, regardless of the cross-sectional shape of inlet 92. One or both axes may be urged in its place by a resilient bias. The maximum size of the comminuted particles may be adjustable up or down during the process by increasing or decreasing the width of gap 96, with the size of slots 16*c*, 32*c* set to the smallest desired maximum particle size.

In the embodiment depicted, inlet 92 has a generally circular cross-sectional area with its centerline generally aligned with the center of gap 96. Alternately, inlet 92 can be configured to transition from a circular cross-sectional shape to a rectangular cross sectional shape without decreasing, thereby more closely matching the cross-sectional shape of the internal flow passageway. The rectangular shape may have the same height (in the vertical direction of the drawings) as the height of rollers 12, 14.

Rollers 12, 14 are configured and operated to advance the particles through gap 96 and in doing so comminute each particle from its respective initial size to a size smaller than a desired maximum size. The rotational speed of rollers 12, 14 is selected to and the surface texture of peripheral surface 12*b*, 14*b* is configured to serve these functions. The minimum rotational speed necessary to ensure that no particles larger than the desired maximum particle size flow downstream from gap 96 may vary with the operating parameters of the system, dependent upon things such as gap size, characteristics of incoming particle size including size, density, purity and speed within the entrained flow, characteristics of the transport gas flow including temperature, density and water content, surface texture and surface finish of peripheral surfaces 12*b*, 14*b*. The rotational speed of rollers 12, 14 may also be set based on the speed of particles when they reach a position proximal rollers 12, 14, for example the rotational speed may be set such that the tangential speed of peripheral surfaces 12*b*, 14*b* is equal to or greater than that speed of the particles.

Figure 6:
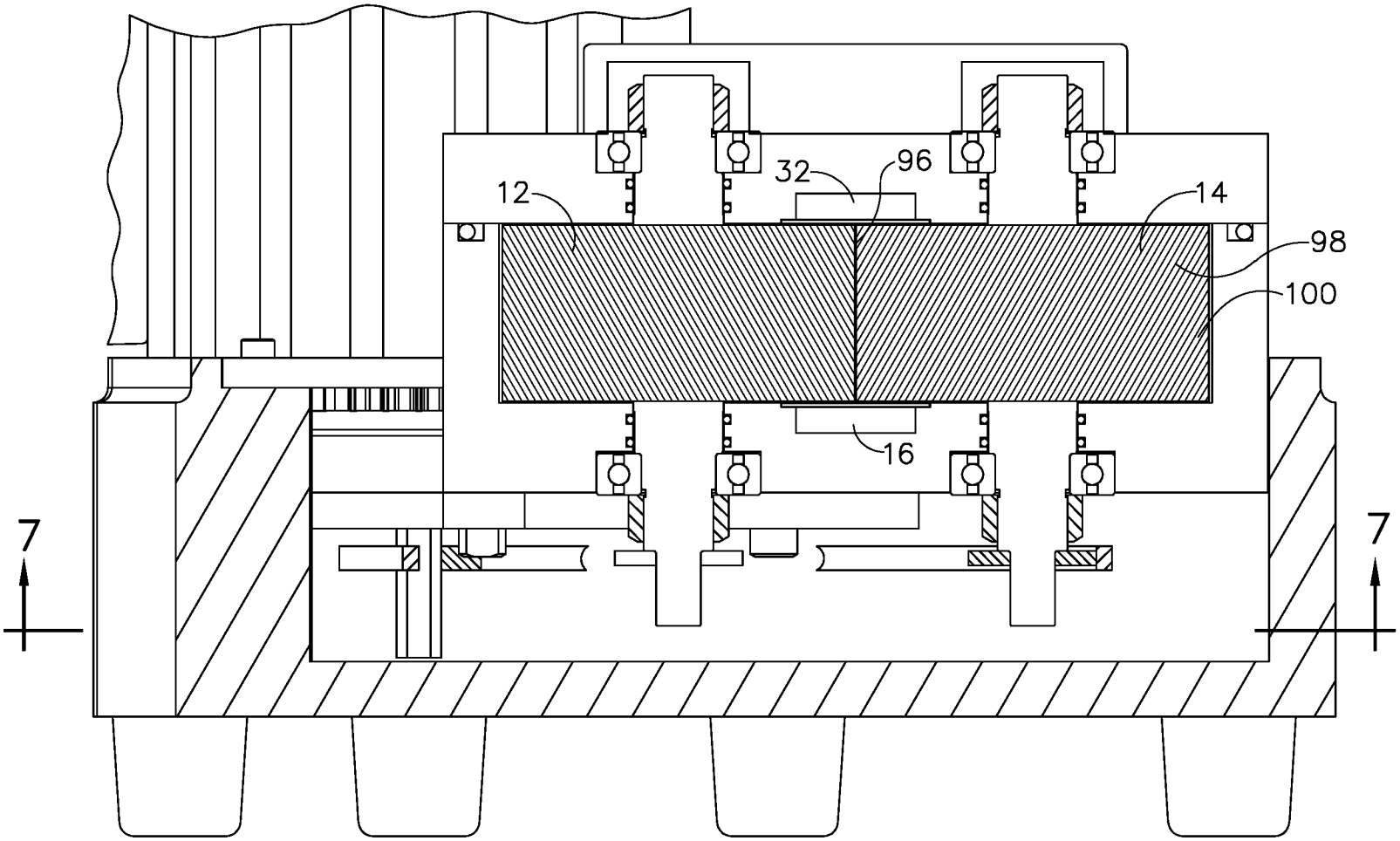
FIG. 6 is side cross-sectional view similar to FIG. 5, with the rollers shown in full.

Referring to FIG. 6, peripheral surfaces 12*b*, 14*b* of rollers 12, 14 are depicted with a surface texture comprising a plurality of raised ridges 98 with valleys 100 interposed between ridges 98. In the embodiment depicted, raised ridges 98 may be considered teeth, which could be formed by knurling peripheral surfaces 12*b*, 14*b*. The angle of the raised ridges 98 may be any suitable angle, such as 30° as depicted, and have any suitable number of teeth per inch (TPI) such as 16 TPI or 21 TPI. Other knurling surface texturing patterns may be used. Knurling is but one way that peripheral surfaces 12*b*, 14*b*, may be texturized. For example, teeth could also be cut about peripheral surfaces 12*b*, 14*b*. The surface finish of the textured peripheral surfaces 12*b*, 14*b*, may also be considered. For example, some knurling operations may produce rough surfaces along one or both of the faces of a tooth. Smoother surface finishes for those faces, such as Ra 32, may be desirable and incorporated, such as may result by cutting the teeth or by forming methods other than knurling. The width of gap 96 for producing comminuted particles smaller than the desired maximum particle size may vary with the specific surface texture of peripheral surfaces 12*b*, 14*b*, as well as may vary with the surface finish. For example, desirable results may be attainable with a 0.005 gap width and 16 TPI, whereas desirable results for 21 TPI may be attainable with a 0.012 gap. As examples of the diameters of rollers 12, 14 for thusly configured peripheral surfaces 12*b*, 14*b*, may be 2.950 inches for a 0.012 gap with 21 TPI, and 2.956 for a 0.005 inch gap with 16 TPI.

Figure 8:
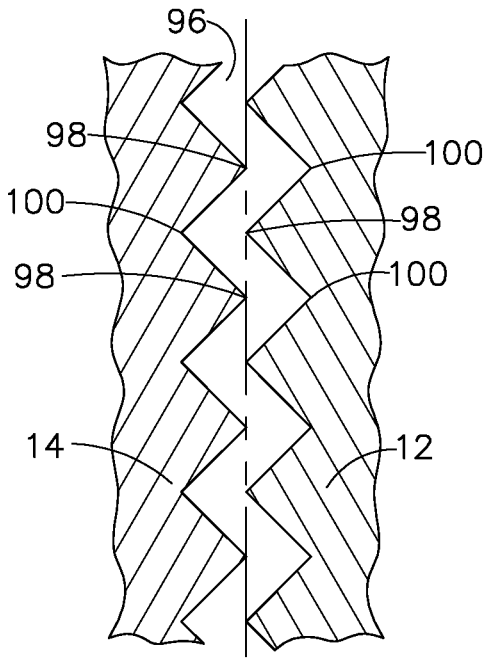
FIG. 8 is an enlarged, fragmentary cross-sectional view taken through the rollers at the gap, illustrating a first embodiment of an alignment and spacing between the rollers.

Peripheral surface 12*b* may be a mirror image of peripheral surface 14*b*, as is depicted in the embodiment illustrated. Referring to FIG. 8, there is shown one embodiment of the alignment of teeth 98 and valleys 100 between rollers 12 and 14 at gap 96. Keeping in mind that teeth 98 and valleys 100 may be, as depicted, helically disposed in peripheral surfaces 12*b*, 14*b*, and thus "wrap" around peripheral surfaces 12*b*, 14*b* as they progress in a direction parallel to axes of rotation 12*a*, 14*a*, FIG. 8 illustrates teeth 98 of one roller aligned with valleys 100 of the other roller. When the rotational speed of rollers 12, 14 are the same and the alignment set as illustrated in FIG. 8, the teeth or peaks of one roller will be synchronized to align with the valleys of the other roller at gap 96 as rollers 12, 14 rotate. In such an embodiment, the gap width may be considered as the distance between the aligned corresponding teeth 98 on one roller and the valley 100 on the other roller.

Figure 9:
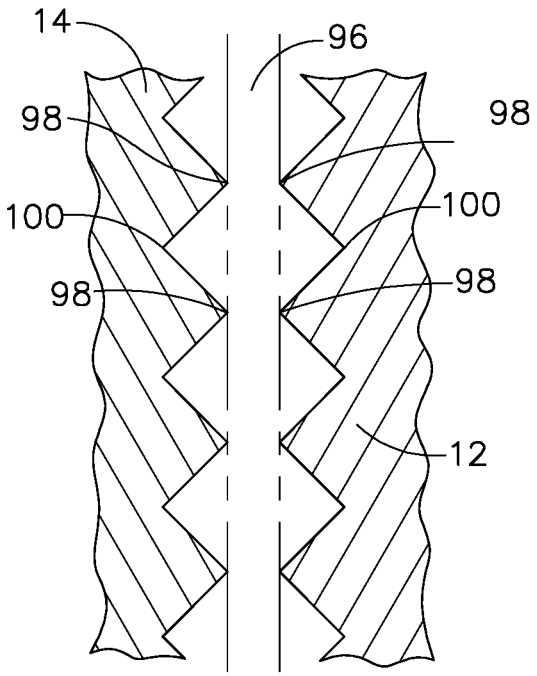
FIG. 9 is an enlarged, fragmentary cross-sectional view taken through the rollers at the gap, illustrating a second embodiment of an alignment and spacing between the rollers.

Referring to FIG. 9, another embodiment of the alignment of teeth 98 and valleys 100 is illustrated. In the embodiment depicted, teeth 98 of each roller are aligned with teeth 98 of the other roller, and, concomitantly, valleys 100 of each roller are aligned with valleys 100 of the other roller. In such an embodiment, the gap width may be considered as the distance between the aligned corresponding teeth on each roller. When the rotational speed of rollers 12, 14 are the same and the alignment set as illustrated in FIG. 9, the teeth or peaks of one roller will be synchronized to align respectively with the teeth and valleys of the other roller at gap 96 as rollers 12, 14 rotate.

Figure 10:
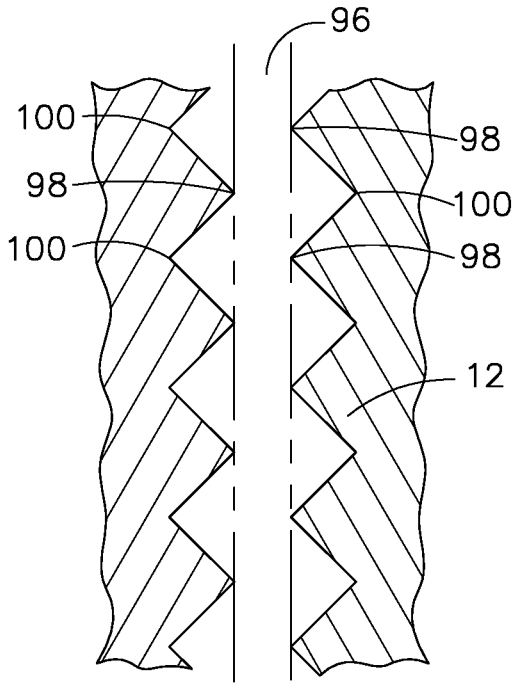
FIG. 10 is an enlarged, fragmentary cross-sectional view taken through the rollers at the gap, illustrating a third embodiment of an alignment and spacing between the rollers.

Referring to FIG. 10, yet another embodiment is illustrated, with the alignment of teeth 98 and valleys 100 the same as illustrated in FIG. 8. However in this embodiment, the width of gap 96 may be considered as the distance between a line passing through the tips of teeth 98 of roller 12 at gap 96 and a line passing through the tips of teeth 98 of roller 14 at gaps 96. Comparing the gap illustrated in FIG. 8 to the gap illustrated in FIG. 10, with both being considered to have the same width (although measured differently), gap 96 of FIG. 8 has a zigzag configuration in a direction parallel to axes of rotation 12*a*, 14*a*, whereas gap 96 of FIG. 10 is straight while the distance between each aligned tooth 98 and valley 100 is greater than the defined width of gap 96. In FIG. 9, the distance between each pair of aligned teeth is the width of gap 96, the distance between each pair of aligned valleys is greater than the defined gap.

In accordance with another embodiment, the alignment between teeth 98 and valleys 100 may be varied by roller 12 rotating at a different rotational speed than roller 14. Additionally, in yet another embodiment, rollers 12 and 14 may be disposed without any attention to the relative alignment of teeth 98 and valleys 100 at gap 96. When the speeds of rollers 12 and 14 are the same, this relative alignment will remain the same for each full rotation. In a still further embodiment, the surface texturing of roller 12 may be different than the surface texturing of roller 14. For example, if the surface texturing includes teeth, rollers 12, 14 may have a different number of teeth per inch, or different depth of valleys 100.

As discussed above, comminutor 2 of the present invention is configured to receive particles from an upstream particle feeder, whether the comminutor is connected directly to the discharge of the upstream particle feeder or the comminutor is connected to an upstream delivery hose. In each case, when the feeder is configured to receive particles from a hopper, the blasting process can be continuous since and as long as the hopper is continuously filled (such as when an upstream pelletizer feeds particle into the hopper). Depending on the specific configuration of the particle feeder, it is possible to configure a comminutor in accordance with the teachings herein so that the entrainment of the particles in the transport gas occurs within the comminutor. The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

EXAMPLE 1

A comminutor configured to reduce the size of cryogenic particles from each particle's respective initial size to a second size which is smaller than a predetermined size, the comminutor comprising: an inlet defining an inlet flow area;

an outlet; a flow passageway placing said inlet in fluid communication with said outlet; a first roller and a second roller disposed downstream of the inlet; a gap defined by and between said first roller and said second roller; and wherein said flow passageway comprises a first intermediate passageway and a second intermediate passageway, wherein said first intermediate passageway comprises said gap, wherein said second intermediate passageway comprises a second intermediate passageway inlet disposed proximal said gap and extending in an upstream direction therefrom.

EXAMPLE 2

A comminutor configured to reduce the size of cryogenic particles from each particle's respective initial size to a second size smaller than a predetermined size, the comminutor comprising: an inlet comprising an inlet area; an outlet; a flow passageway placing said inlet in fluid communication with said outlet; a first roller and a second roller disposed downstream of the inlet; a gap defined by and between said first roller and said second roller; and wherein said flow passageway comprises a first intermediate passageway and a second intermediate passageway, wherein said first intermediate passageway comprises said gap, wherein said second intermediate passageway comprises a second intermediate passageway exit disposed proximal said gap and extending in a downstream direction therefrom.

EXAMPLE 3

A comminutor configured to reduce the size of cryogenic particles from each particle's respective initial size to a second size smaller than a predetermined size, the comminutor comprising: an inlet comprising an inlet area, wherein the inlet is connectable to a source of entrained particle flow; an outlet; a flow passageway placing said inlet in fluid communication with said outlet; a first roller and a second roller disposed downstream of the inlet; a gap defined by and between said first roller and said second roller, wherein the first and second rollers are configured to advance particles of the entrained particle flow through the gap, wherein said first roller has a respective peripheral surface first tangential speed at the gap, wherein said second roller has a respective peripheral surface second tangential speed at the gap, wherein at least one of the first and second tangential speeds is greater than the speed of the particles when the particles arrive at the gap.

EXAMPLE 4

The comminutor of example 4, wherein said first and second tangential speeds are equal.

EXAMPLE 5

A comminutor configured to reduce the size of cryogenic particles from each particle's respective initial size to a second size smaller than a predetermined size, the comminutor comprising: an inlet comprising an inlet area; an outlet; a flow passageway placing said inlet in fluid communication with said outlet; a first roller and a second roller disposed downstream of the inlet, wherein the first roller has a first roller peripheral surface, wherein the second roller has a second roller peripheral surface, wherein the first roller peripheral surface comprises a first plurality of raised ridges, wherein the second roller peripheral surface comprises a second plurality of raised ridges, wherein the first roller peripheral surface is a mirror image of the second roller peripheral surface; a gap defined by and between said first roller and said second roller; and wherein said flow passageway comprises at least a first intermediate passageway, wherein said first intermediate passageway comprises said gap.

EXAMPLE 6

The comminutor of Example 5, wherein the raised ridges of the first plurality of raised ridges are disposed at an angle.

EXAMPLE 7

The comminutor of any of the examples, wherein the second intermediate passageway defines a second intermediate passageway flow area, and wherein the second intermediate passageway flow area is approximately the same as the inlet flow area.

EXAMPLE 8

The comminutor of any of the examples, wherein the second intermediate passageway comprises two passageways.

EXAMPLE 9

The comminutor of any of the examples, wherein each roller comprises respective upper ends and respective lower ends, and wherein the second intermediate passageway is disposed adjacent the upper ends.

EXAMPLE 10

The comminutor of any of the examples, wherein the gap has a width and wherein the width is adjustable.

EXAMPLE 11

The comminutor of any of the examples, wherein the first roller is resiliently biased toward the gap.

EXAMPLE 12

The comminutor of any of the examples, wherein pressure of flow flowing through the second intermediate passageway is lower than pressure of flow exiting the gap.

EXAMPLE 13

The comminutor of any of the examples, wherein raised ridges of the first plurality of raised respectively align with raised ridges of the second plurality of raised ridges at the gap.

EXAMPLE 14

A method of comminuting cryogenic particles from each particle's respective initial size to a second size smaller than a predetermined size, the method comprising: directing a flow of entrained cryogenic particles toward a gap; at a first location, splitting the flow into at least a first flow and a second flow, wherein the first location is upstream of and proximal to the gap, wherein cryogenic particles are entrained in the first flow, wherein the first flow travels through the gap, wherein substantially no cryogenic particles are entrained in the second flow; and rejoining the second flow with the first flow at a second location, wherein the second location is downstream of and proximal to the gap.

EXAMPLE 15

The method of example 14, wherein the gap comprises an inlet and an outlet, wherein pressure of the second flow at the second location is lower than pressure of the first flow at the outlet of the gap.

EXAMPLE 16

The method of example 14, wherein the step of directing the flow comprises directing the flow in a first direction, and wherein at least a portion of the second flow is directed in the first direction.

The foregoing description of one or more embodiments of the innovation has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the innovation and its practical application to thereby enable one of ordinary skill in the art to best utilize the innovation in various embodiments and with various modifications as are suited to the particular use contemplated. Although only a limited number of embodiments of the innovation is explained in detail, it is to be understood that the innovation is not limited in its scope to the details of construction and arrangement of components set forth in the preceding description or illustrated in the drawings. The innovation is capable of other embodiments and of being practiced or carried out in various ways. Also specific terminology was used for the sake of clarity. It is to be understood that each specific term includes all technical equivalents which operate in a similar manner to accomplish a similar purpose. It is intended that the scope of the invention be defined by the claims submitted herewith.

The invention claimed is:

1. A comminutor configured to reduce size of cryogenic particles from each particle's respective initial size to a second size which is smaller than a predetermined size, the comminutor comprising:

a. an inlet defining an inlet flow area;

b. an outlet;

c. a flow passageway placing said inlet in fluid communication with said outlet;

d. a first roller and a second roller disposed downstream of the inlet;

e. a gap defined by and between said first roller and said second roller; and wherein said flow passageway comprises a first intermediate passageway and a second intermediate passageway, wherein said first intermediate passageway comprises said gap, wherein said second intermediate passageway comprises a recess and a second intermediate passageway inlet, the second intermediate passageway inlet disposed proximal said gap and extending in an upstream direction from said gap.

2. The comminutor of claim 1, wherein the second intermediate passageway defines a second intermediate passageway flow area, and wherein the second intermediate passageway flow area is no smaller than the inlet flow area.

3. The comminutor of claim 1, wherein the second intermediate passageway comprises two passageways.

4. The comminutor of claim 1, wherein the first roller and the second roller each comprises respective upper ends and respective lower ends, and wherein the second intermediate passageway is disposed adjacent the upper ends.

5. The comminutor of claim 1, wherein the gap has a width and wherein the width is not adjustable.

6. The comminutor of claim 1, wherein the first roller is not resiliently biased toward the gap.

7. A comminutor configured to reduce size of cryogenic particles from each particle's respective initial size to a second size smaller than a predetermined size, the comminutor comprising:

a. an inlet comprising an inlet area;

b. an outlet;

c. a flow passageway placing said inlet in fluid communication with said outlet;

d. a first roller and a second roller disposed downstream of the inlet;

e. a gap defined by and between said first roller and said second roller; and wherein said flow passageway comprises a first intermediate passageway and a second intermediate passageway, wherein said first intermediate passageway comprises said gap, wherein said second intermediate passageway comprises a recess and a second intermediate passageway exit, the second intermediate passageway exit disposed proximal said gap and extending in a downstream direction from said gap.

8. The comminutor of claim 7, wherein the second intermediate passageway is configured to cause the fluid pressure of flow flowing through the second intermediate passageway to be lower than the fluid pressure of flow exiting the gap.

9. The comminutor of claim 1, wherein the inlet is configured to be connected to a source of entrained particle flow and wherein the first and second rollers are configured to advance particles of the entrained particle flow through the gap, wherein said first roller has a respective peripheral surface first tangential speed at the gap, wherein said second roller has a respective peripheral surface second tangential speed at the gap, wherein at least one of the first and second tangential speeds is greater than the speed of the particles when the particles arrive at the gap.

10. The comminutor of claim 1, wherein the first roller has a first roller peripheral surface, wherein the second roller has a second roller peripheral surface, wherein the first roller peripheral surface comprises a first plurality of raised ridges, wherein the second roller peripheral surface comprises a second plurality of raised ridges, wherein the first roller peripheral surface is a mirror image of the second roller peripheral surface.

11. The comminutor of claim 10, wherein the raised ridges of the first plurality of raised ridges are disposed at an angle relative to the axis of rotation of the first roller.

12. The comminutor of claim 9, wherein said first and second tangential speeds are equal.

* * * * *